US007316542B2

(12) United States Patent
Mills

(10) Patent No.: US 7,316,542 B2
(45) Date of Patent: Jan. 8, 2008

(54) FLUID LEVEL CONTROL SYSTEM

(75) Inventor: Manuel D. Mills, Midland, TX (US)

(73) Assignee: DJAX Corporation, Midland, TX (US)

( * ) Notice: Subject to any disclaimer, the term of this patent is extended or adjusted under 35 U.S.C. 154(b) by 583 days.

(21) Appl. No.: 10/888,394

(22) Filed: Jul. 9, 2004

(65) Prior Publication Data

US 2005/0238496 A1 Oct. 27, 2005

Related U.S. Application Data

(63) Continuation-in-part of application No. 10/831,054, filed on Apr. 26, 2004.

(51) Int. Cl.
*F04B 49/06* (2006.01)

(52) U.S. Cl. ..... 417/42; 417/44.1; 417/53

(58) Field of Classification Search ..... 417/42, 417/44.1, 53

See application file for complete search history.

(56) References Cited

U.S. PATENT DOCUMENTS

| | | | | |
|---|---|---|---|---|
| 4,490,094 | A | 12/1984 | Gibbs | |
| 4,508,488 | A * | 4/1985 | Pikna | 417/44.1 |
| 4,631,954 | A * | 12/1986 | Mills | 417/12 |
| 4,873,635 | A | 10/1989 | Mills | |
| 5,291,777 | A | 3/1994 | Chang et al. | |
| 5,362,206 | A * | 11/1994 | Westerman et al. | 417/44.11 |
| 5,372,482 | A | 12/1994 | London et al. | |
| 5,458,466 | A * | 10/1995 | Mills | 417/42 |
| 5,819,849 | A * | 10/1998 | Booth | 166/252.1 |
| 6,085,836 | A | 7/2000 | Burris et al. | |
| 6,456,201 | B1 | 9/2002 | Mioduszewski et al. | |
| 6,481,499 | B2 | 11/2002 | Lopes | |
| 6,554,066 | B2 | 4/2003 | Lopes et al. | |
| 2005/0095140 | A1* | 5/2005 | Boren et al. | 417/42 |
| 2006/0067834 | A1* | 3/2006 | Boyer et al. | 417/44.1 |

* cited by examiner

*Primary Examiner*—Michael Koczo, Jr.
(74) *Attorney, Agent, or Firm*—Browning Bushman P.C.

(57) ABSTRACT

A control system governs fluid level in a well system including a pump positioned downhole for pumping fluid upward through a tubular, a rod positioned within the tubular for driving the pump, a prime mover, and a pumpjack to transmit power from the prime mover to the rod to reciprocate the rod. A sensor senses a position of the rod or a member of the pumpjack and outputting signals in response thereto. A controller receives the signals and computes a plurality of time intervals, each time interval being between signals and occurring during at least a portion of an upstroke of the rod. The controller selectively decreases power output from the prime mover in response to an increase in the computed time interval.

20 Claims, 4 Drawing Sheets

FLUID LEVEL CONTROL SYSTEM

RELATED CASE

This Application is a continuation in part of U.S. application Ser. No. 10/831,054 filed Apr. 26, 2004.

FIELD OF THE INVENTION

This invention relates generally to pump controllers for downhole pumps used in the hydrocarbon recovery industry. More specifically, this invention relates to a control system for controlling fluid level within a well system.

BACKGROUND OF THE INVENTION

In the hydrocarbon recovery industry, pumps are used at the lower ends of wells to pump water or oil to the surface through production tubing positioned within a well casing. The production tubing is generally positioned within a casing, with an annulus formed therebetween. Fluid from the formation enters the annulus and is pumped upwardly through the production tubing. Power is transmitted to the pump from the surface using a rod string positioned within the production tubing. Rod strings include both "reciprocating" types used with "beam pumping units", which are axially stroked, and "rotating" types for use with progressive cavity pumps, which rotate to power progressing cavity pumps.

As to both reciprocating and rotating type pumps, if the rate of pumping exceeds the rate of supply by the formation, fluid level in the annulus will be lowered. If the fluid level drops too low, and especially if the fluid level falls below the upper end of the pump, the pump can be damaged. Likewise, if the rate of supply by the formation exceeds the rate of pumping, fluid level will rise. If the fluid level is too high, however, the well is not producing at maximum capacity, and production revenues are not maximized. There is accordingly a trade-off between pumping at high and low fluid levels.

Some systems have been proposed for timing pump strokes of a reciprocating type rod. U.S. Pat. No. 4,873,635 to Mills discloses a pump-off control device for use with a reciprocating type rod. The device uses the occurrence of a pump-off or partial pump-off condition, which means the fluid has dropped below full barrel. As the fluid level drops to below full barrel, the downstroke naturally speeds up due to the presence of air. The device measures the length of time required for the pump to downstroke successive numbers of times, and when the time differential reaches a predetermined value indicating a pump-off condition, the well is shut in for a time interval.

U.S. Pat. No. 4,490,094 discloses a method whereby instantaneous speeds of revolution for a beam pumping unit prime mover rotor are compared to predetermined values to correct pumping unit operation, such as during pump-off, mechanical malfunction, electrical operating inefficiency, or pumping unit imbalance. These systems are limited to use with reciprocating type pumps.

Particularly as to progressive cavity pumps coupled with rotating rod strings, as fluid level in the annulus drops, the hydrostatic pressure is reduced and the prime mover that powers rotation of the rod must work harder. Conversely, a higher fluid level increases hydrostatic pressure, which assists a progressive cavity pump by reducing the "head," which is a spacing between the fluid level and the surface. Production from the well can be optimized if the fluid level is maintained at a certain value or range of values. The prior art discloses a number of approaches to detecting fluid level. For example, U.S. Pat. No. 6,085,836 discloses a method of transmitting sonic signals into the annulus to determine fluid level. U.S. Pat. No. 5,372,482 discloses a way to monitor fluid level indirectly from variation in the power consumption of an electrical motor. This patent eliminates the need for downhole pressure sensors and amperage monitors.

In recent years, gas producing companies have discovered that gas can be profitably produced by drilling into coal beads and pumping out the water. Lowering the hydrostatic head pressure by removing the water permits the gas to flow to the surface. The progressive cavity pump has been found to be a very cost effective way to remove the water from these coal sands and to lower hydrostatic head pressure. The fluid level in the annulus above the progressive cavity pump needs to be controlled at a level that always gives sufficient pump submergence. If there is insufficient pump submergence the progressive cavity pump can be damaged or destroyed, which is expensive to repair or replace.

Other patents of interest include U.S. Pat. Nos. 6,456,201; 6,481,499; 6,554,066; and 5,291,777.

SUMMARY OF THE INVENTION

Both a control system and method are disclosed for governing fluid level in a well system. The well system includes a pump positioned downhole for pumping fluid upward through a tubular, a rod positioned within the tubular for driving the pump, a prime mover, and a pumpjack to transmit power from the prime mover to the rod to reciprocate the rod. The control system comprises a sensor for sensing a position of the rod or a member of the pumpjack and outputting signals in response thereto. The control system also comprises a controller for repeatedly receiving the signals and computing a time interval between signals, at least a portion of an upstroke of the rod occurring during the time interval. The controller selectively decreases power output from the prime mover in response to an increase in the computed time interval.

In some embodiments, the controller decreases power output from the prime mover when the computed time interval increases by more than a predetermined time increment. The predetermined time increment may be computed as a difference between the time interval corresponding to an upper fluid level and the time interval corresponding to a lower fluid level when pumping the fluid level down from the upper fluid level to the lower fluid level at a distinct power output setting of the prime mover. An ultrasonic level detector may be used to compute a height of at least one of the upper and lower fluid levels.

In some embodiments, the controller decreases power output from the prime mover by changing the prime mover from a distinct upper power setting to a distinct lower power setting. In other embodiments, the controller decreases power output from the prime mover by turning off the prime mover. The controller may increase power output from the prime mover after a selected period of time at the decreased power output.

In some embodiments, the sensor senses positioning of the rod or the member of the pumpjack at a selected position, and the controller computes the time interval between a positioning at the selected position and a subsequent positioning at the same selected position. In other embodiments, the sensor senses positioning of the rod at a plurality of distinct positions, and the controller computes the time interval between positioning of the rod at one of the distinct positions and subsequent positioning of the rod at another of the distinct positions.

The prime mover may comprise a variable frequency motor.

The foregoing is intended to summarize the invention, and not to limit nor fully define the invention. The aspects of the invention will be more fully understood and better appreciated by reference to the following description and drawings.

DETAILED DESCRIPTION OF PREFERRED EMBODIMENTS

Figure 1:
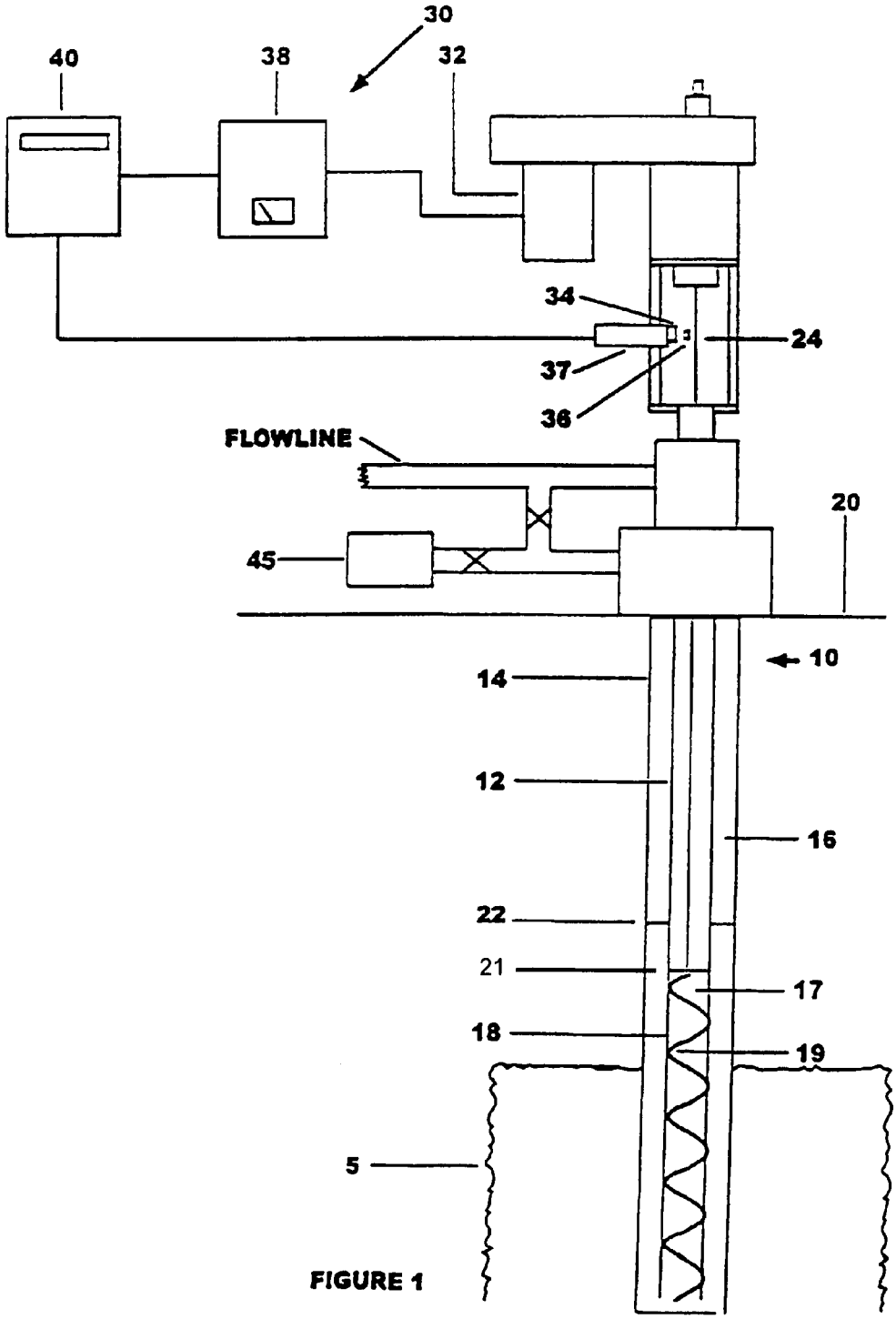
FIG. 1 conceptually illustrates an embodiment of a control system for use with a well system including a progressive cavity pump and a rotating rod.

FIG. 1 schematically shows a hydrocarbon recovery well indicated generally at 10 passing through an oil-bearing formation 5. A production tubing or tubular 12 is disposed within a casing 14, with an annulus 16 formed therebetween. Fluid from the formation 5 passes into the annulus 16. A progressive cavity pump 18 is positioned downhole for pumping fluid from the annulus 16 upward through the interior of production tubing 12 to the surface 20. The progressive cavity pump 18 is the type of pump powered by rotation (rather than reciprocation) of a rod string 24. A variable level fluid column 21 results in the annulus 16.

The "head" is defined as the distance from the top 22 of the variable-level fluid column 21 to the surface 20. The lower the head (i.e. the higher the top 22 of the fluid column 21), the less the pump 18 must work to pump fluid to the surface 20. This is because the hydrostatic pressure of the fluid column 21, which is a function of the height of the fluid column 21, effectively "assists" the pump 18. If the fluid level gets too low, the pump 18 may be operating inefficiently because of the higher power requirement at low fluid levels. If the fluid level drops to the fluid intake of the pump 18, such as when the pump 18 has been operating too fast, the pump 18 will likely be destroyed. Conversely, the well 10 is not operating at capacity when the fluid level is too high. Thus, there can be ascertained an "optimum fluid level" whereby operation of the well 10 is optimized. More practically, a range of acceptable fluid level can be ascertained. A goal of a prudent well operator is to operate the well 10 as close to the optimum fluid level as possible, or at least within the acceptable range, to maximize production without consuming excessive power or damaging the pump 18.

Some embodiments of the invention control fluid levels in well systems having rotating rods coupled with progressive cavity pumps. FIG. 1 further illustrates a preferred embodiment of a control system, indicated generally at 30, for controlling the progressive cavity pump 18 in the well 10 as shown in FIG. 1. A prime mover 32, which is preferably an electrically-operated or fluid-operated variable speed drive 32, drives rotation of the rod 24. A sensor 34 is positioned adjacent the rod 24. The sensor 34 outputs signals responsive to rotational positioning of the rod 24 at a preselected rotational position of the rod 24. More particularly, as shown, the sensor 34 comprises a proximity sensor having a first member 36 secured to the rod 24 for rotating with the rod 24, and a stationary second member 37 structurally separate from the first member 36 for sensing the proximity of the first member 36 at the rotational position shown. The rotational position at which the rotating first member 36 is aligned with the stationary second member 37 is selected to be reached with every 360-degree rotation of the rod 24. The sensor 34 outputs a signal to a controller 40 whenever the rod 24 reaches this rotational position. The controller 40 receives the signals and computes a time interval between selected signals, such as between one or more revolutions of the rod 24. The controller 40 then references a data set (discussed further below), which is preferably included within operating software of the controller 40, compares the computed time interval to the data set, and controls power to the prime mover 32 in response.

When the prime mover 32 is a variable speed drive, the controller 40 may selectively signal the prime mover 32 to increase or decrease power to increase or decrease rotation rate of the rod 24. Although increasing or decreasing power will speed up or slow down rotation of the rod 24, the rod 24 will not likely remain precisely at that increased or decreased rotation rate, because the rotation rate of the rod 24 is not simply a function of the power output of the prime mover 32 alone. This is because the variable height of the fluid column 21 results in the variable amount of head discussed above, which in turns provides variable resistance to the pump 18. Thus, for a given amount of power output from the prime mover 32, the rotation rate of the rod 24 will also depend to some extent on the height of fluid column 21. For example, if fluid level is too high, the power to the prime mover 32 can be increased, and the rotation rate of the rod 24 will increase temporarily to pump out fluid faster. However, the rod rotation rate will gradually slow, even at the increased power, as the fluid column 21 is drawn downward.

Fortunately, it can be determined in advance with reasonable reliability that the fluid column 21 can be maintained at a fairly constant level corresponding to a constant rod rotation rate. Preferably using portable ultrasonic level calibration equipment conceptually illustrated at 45, each well can be calibrated by ascertaining the rod rotation rate required to maintain the fluid column 21 at a certain height. Thus, rotation rates required to maintain the fluid column 21 within the maximum and minimum fluid levels, and/or at the optimum fluid level discussed above, may be determined experimentally using the sonic well equipment. This information may be incorporated as time-related reference parameters within the data set of the controller 40. In one embodiment, the data set may include a rotation rate (RPMs) for each of the desired fluid levels (e.g. maximum/minimum or optimum). The controller 40 may compute the actual rotation rate of the rod as a function of the computed time interval and corresponding number of rod rotations. The controller 40 may then compare the actual rotation rate to the data set. For example, in a "2-setting" embodiment, if the actual rotation rate falls below the optimum rate, the controller 40 may signal the prime mover 32 to increase power to an upper power setting. Similarly, the controller 40 may signal the prime mover 32 to increase power to the upper power setting when/if rotation rate falls below the minimum, or decrease power to a lower power setting when/if the rotation rate rises above the maximum. In other embodiments, the data set need not specifically include reference rotation rates. The data set may instead include other time-related parameters such as reference time intervals, measured as the time intervals required for the rod to rotate a certain number of revolutions at respective rotation rates corresponding to the various fluid levels.

EXAMPLE 1

The prime mover has an upper and lower power setting. The controller is set up to measure a time interval for 30 rod revolutions. Using an ultrasonic level detector to calibrate the well, the "optimum" fluid level is predetermined to be 300 feet, at which the rod rotation rate is 400 RPM. For 30 revolutions at 400 RPM (optimum), the time interval is 4.5 seconds (4500 ms). Thus, one value in the data set is the time interval of 4500 ms. Similarly, the maximum fluid level corresponds to a time interval of 4520 ms and the minimum fluid level corresponds to 4480 ms (a time difference "delta-t" of +/−20 ms). These values may also be programmed into the controller. After calibration, the control system is ready for operation. The controller will "know" to decrease power when the time interval rises above 4520 ms and increase power when the time interval drops below 4480 ms. For instance, if the prime mover is operating at the lower power setting and the measured time interval reaches 4522 ms, the controller will compare this to the data set, determine the delta-t has been exceeded, and signal the prime mover to increase power to the upper power setting to lower the fluid level and a corresponding time interval of 4500 ms.

Although the above example is idealized, it illustrates the logic and functionality of one embodiment of the control system. It further illustrates the importance of measuring the time interval for a plurality of revolutions, because even at 30 revolutions a delta-t of 20 ms corresponds to a difference of only about +/−2 RPM.

In a less preferred "on/off" type embodiment, the prime mover 32 may instead be cycled on and off. Turning off power will stop the pump by halting rotation of the rod 24, allowing the fluid column 21 to rise. Turning the power back on will draw the fluid column 21 back downward. The powered-on pump 18 can remain on until the controller 40 determines the column 21 has dropped below the optimal or minimum fluid levels, via the logic discussed above.

In a "continuously variable" embodiment, the prime mover 32 may have a continuously variable power range, and a more sophisticated logic circuit within controller 40 may signal the prime mover 32 not only to simply increase or decrease power, but to increase or decrease power by a certain increment. For example, if the comparison of actual time intervals to the referenced data set reveals the fluid level is only slightly above the optimum level, the controller 40 may signal the prime mover 32 to increase power by only a small increment.

In all embodiments discussed, the prime mover 32 may include a power gauge 38 to indicate power to the prime mover 32. For example, in the on/off embodiment, the gauge 38 may simply indicate power is on or off. In the 2-setting embodiment, the gauge may indicate whether the prime mover 32 is at the upper power setting (such as "60 Hz") or the lower power setting (such as "50 Hz"). In the continuously variable embodiment, the gauge 38 may indicate the specific power setting within the continuously variable range.

Although not preferred, rotational positions in some embodiments could be spaced at less than 360 degrees. For example, if the first member 36 included two pieces (not shown) directly opposite one another with respect to the rod 24, the rotational positions would be spaced at 180 degrees, and two rotational positions could be included within every 360-degree rotation of the rod 24. Furthermore, the time intervals need not be computed between 2 consecutive signals. To obtain better resolution, the time interval could be computed over multiple revolutions of the rod 24. For instance, computing the time interval over a selected number of 10-30 revolutions will likely result in a more accurate and meaningful computation of rotation rate, because the difference in time for only a few revolutions at the maximum or minimum fluid level may not be detectable. Selecting too high a number of revolutions, such as 500 revolutions, is generally not advisable, because by the time the rod 24 rotates that many revolutions, it may be too late to adjust the power setting.

Figure 2:
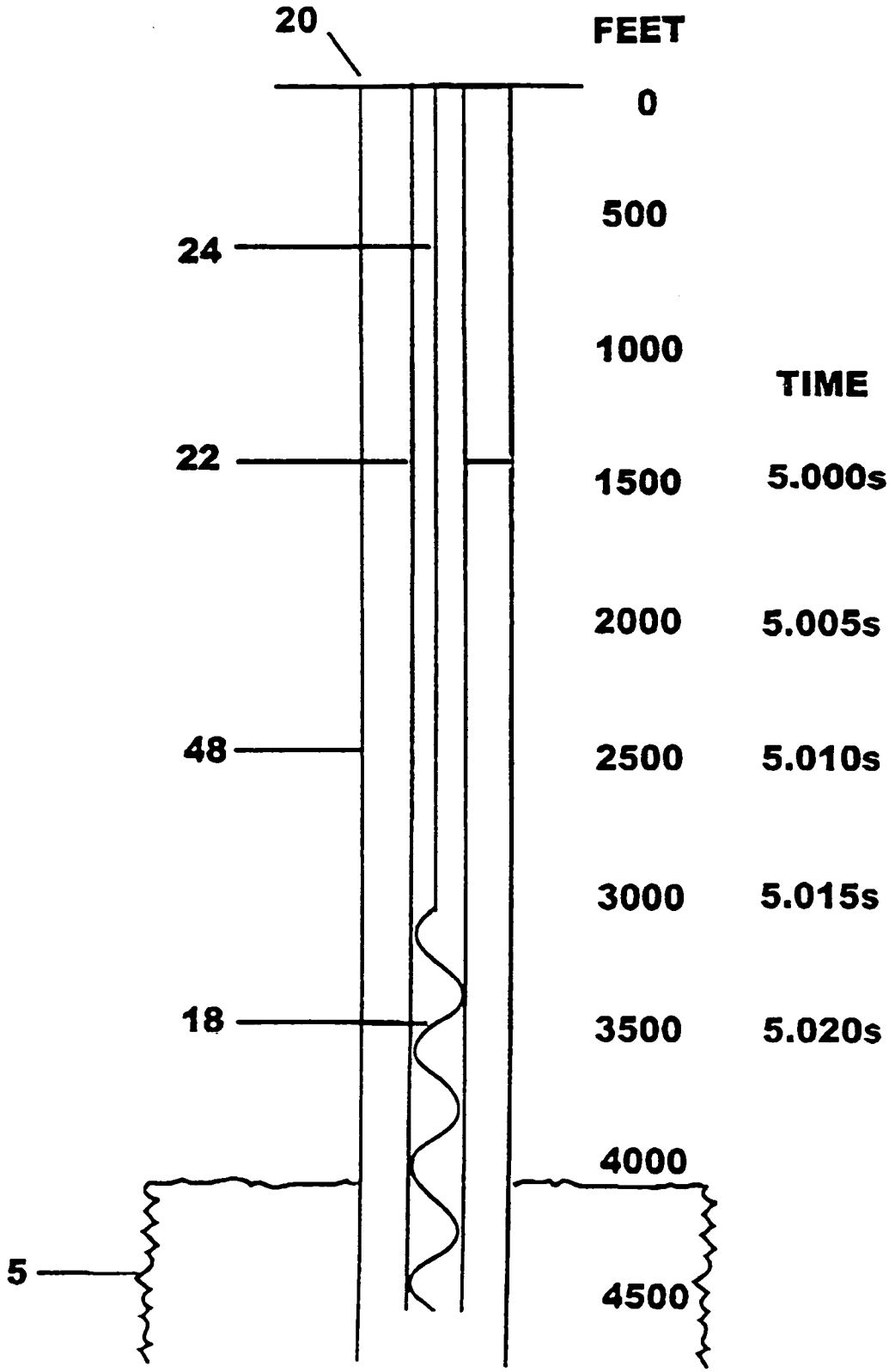
FIG. 2 illustrates a typical fluid level/time chart for controlling a progressive cavity pump as shown in FIG. 1.

FIG. 2 illustrates the fluid level in a well, wherein the top of the fluid level 22 is at approximately 1400 feet and the target fluid level 48 is approximately 2500 feet. Next to specific depth indications is a detected time in seconds for a specific number of rod revolutions. With a decreasing depth level, the time increases by 0.5 milliseconds with each additional 500 feet in depth. FIG. 2 may thus be used by the operator to maintain a target fluid level 48 of approximately 2500 feet in response to the measured time for the rod to rotate a specific number of turns.

Figure 3:
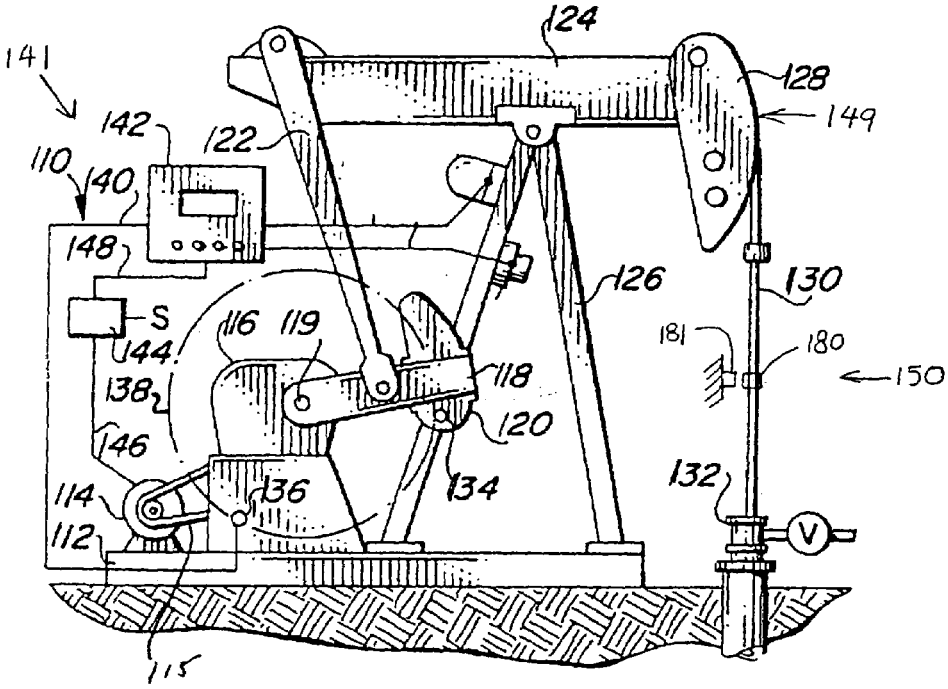
FIG. 3 conceptually illustrates an embodiment of a control system for use with a well system including a beam pumping unit and a reciprocating rod.

Other embodiments of the invention may be used to control fluid level in well systems having beam pumping units coupled with reciprocating rod strings. The downstroke of the rod is substantially unaffected by fluid level when operating under full-barrel conditions. The hydrostatic pressure associated with fluid level affects the upstroke of the rod, however, so the speed of the upstroke is indicative of fluid level. FIG. 3 discloses a well system generally indicated at 150 having a beam pumping unit for use with a reciprocating type rod. Well system 150 includes the pumpjack unit 149 in combination with a pump-off control system 110 made in accordance with the present invention. The pumpjack unit 149 includes base 112, high slip three phase motor 114, and a gear box 116 which rotates crank 118 in the indicated circle 138 about a center defined by shaft 119. Counterweight 120 is fastened to the rotating free end of the crank 118. Pitman 122 connects the crank 118 to a walking beam 124. The walking beam 124 is journaled to the upper end of the Sampson post 126. Horsehead 128 receives the illustrated bridle thereon for reciprocating the rod 130. Stuffing box 132 sealingly receives the rod 130 and forms the upper terminal end of the wellbore. A pump 115 (FIG. 6) is located downhole in the usual manner. Pumpjack 149 thereby transmits power from motor 114 to rod 130 to reciprocate the rod 130 and drive the pump 115.

The high slip motor 114 drives the reduction gear box 116 which rotates the shaft 119 and thereby oscillates the horsehead 128, which in turn reciprocates the rod 130. The rod 130 is connected to a rod string (not shown) which reciprocates the plunger of pump 115. Production occurs through the indicated valve V.

The control system 110 includes a position sensor, of which there may be several types. The type of position sensor shown includes a traveling magnet located at position 134. Magnet 134 is attached to the side of the counterweight 120 and rotates past an adjacent gear box 116. Also included with this type of position sensor is a transducer mounted where shown by the numeral 136. The transducer 136 is responsive to the lines of magnetic flux effected by magnet 134 as it travels past the transducer 136.

Figure 4:
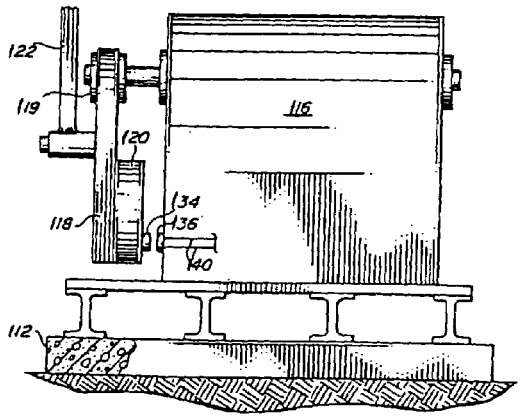
FIG. 4 conceptually illustrates one embodiment of a position sensor for use with the embodiment of FIG. 3.

FIG. 4 illustrates one manner in which the magnet 134 can be attached to the cyclically moving parts of the pumpjack apparatus. In FIG. 3, the traveling magnet 134 is attached by any suitable means to the counterweight 120 (a component of pumpjack 149), while the transducer 136 is attached in fixed relationship respective to the gear box 116, and in close proximity to the magnet 134, so that a signal is generated within the conductor 140 each 360 degree rotation of the counterweight 120. Thus, the sensor that includes magnet 134 and transducer 136 senses position of the counterweight 120 by outputting signals in response to alignment of the magnet 134 and transducer 136. Furthermore, because the components of the pumpjack move cooperatively in a cyclical fashion, a sensor secured to one component of the pumpjack such as counterweight 120 may indicate positioning of other components of the pumpjack, such as Pitman 122, walking beam 124, horsehead 128, or the sheave on the gearbox driven by motor 114 and the belt 115. The sensor may likewise indicate positioning of the rod 130, which is cooperative with the pumpjack 149 to move in its cyclical, reciprocating fashion.

In some embodiments, sensor components may alternatively be secured to other cyclically moving components of the pumpjack, or to the rod 130 itself. For example, FIG. 3 further shows optional placement of an alternative sensor including magnet 180 secured to the rod 130 and transducer 181 spaced from and structurally separate from magnet 180. As the rod 130 moves in its cyclically stroking fashion, magnet 180 moves relative to transducer 181, and transducer 181 generates signals responsive thereto. Again, there is no limitation that the sensor include a magnet and transducer. Other position-type sensors are known in the art that may be suitable for use with the invention, such as optical sensors and a variety of other proximity sensors.

Figure 5:
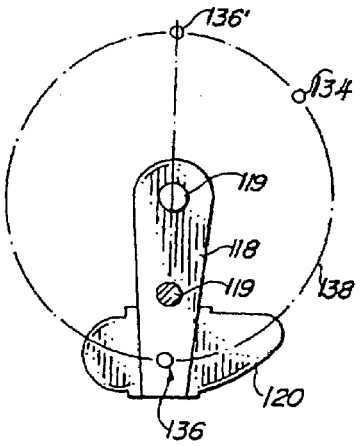
FIG. 5 conceptually shows an alternative embodiment of a control system suitable for use with the well system of FIG. 3, having a plurality of distinct locations for the arrangement of position sensors.

In FIG. 4, position is sensed at a single selected position, which is reached with every 360 degrees of movement. In FIG. 5, by comparison, numerals 136 and 136' indicate that a plurality of transducers can be arranged at a plurality of distinct locations along the circle 138 described by the rotating magnet 134 so that the rotating magnet 134 will sequentially cut the transducers with lines of magnetic flux, thereby providing two signals each 360 degrees of rotation.

The control system 110 also includes electrical conductor 140 connecting the transducer 136 to a pump-off control circuitry 142. A motor controller 144 connects a source S of electrical current to the motor 114 by means of the illustrated conductors 146. Conductors 148 connect the pump-off control circuitry 142 to the motor controller 144. The control circuitry 142 receives the signals from the sensor transducer 136 and computes a plurality of time intervals, each time interval being between signals. For example, the control circuitry 142 may time each 360 degree revolution of the counterweight 120 by timing the interval between signals generated. The control circuitry 142 may similarly time other prescribed intervals, such as the time interval between two or more 360 degree revolutions, or the time interval between a signal from transducer 136 and a signal from transducer 136'. This time interval thus may represent all or a portion of the upstroke of the rod 130.

The invention preferably operates under full-barrel conditions, and the duration of the upstroke of the rod 130 is thereby affected by the hydrostatic pressure related to the fluid level. The time interval recorded should therefore occur during at least a portion of an upstroke of the rod 130, to be sensitive to changes in the fluid level in the well system 150. The changes in the time interval during an upstroke of the rod under full-barrel conditions are more subtle than changes in a time interval would be during the downstroke under less-than-full-barrel conditions, potentially requiring more precise timing equipment and calibration. Under typical full-barrel operating conditions, an increasing time interval is generally indicative of a decreasing fluid level, because there is decreasing hydrostatic pressure within the well system 150 to effectively assist the pump 115. The control circuitry 142 thus selectively decreases power output from the prime mover (the motor 114) in response to an increase in the computed time interval. The control circuitry 142 may do so in this embodiment by signaling the motor controller 144 to reduce power output to the motor 114. For example, because the motor 114 shown is a three-phase motor, the motor controller 144 may reduce the power of the motor 114 from a discrete upper power setting to a discrete lower power setting, e.g. from 60 hz to 50 hz. Alternatively, the motor controller 144 may turn off power output from the motor 114. Turning off power output from the motor typically includes simply turning the motor 114 off. Reducing power output from the motor 114 desirably reduces power to the rod 130 and decreases pumping rate, preferably so that the fluid level will stop falling and begin to rise.

Figure 6:
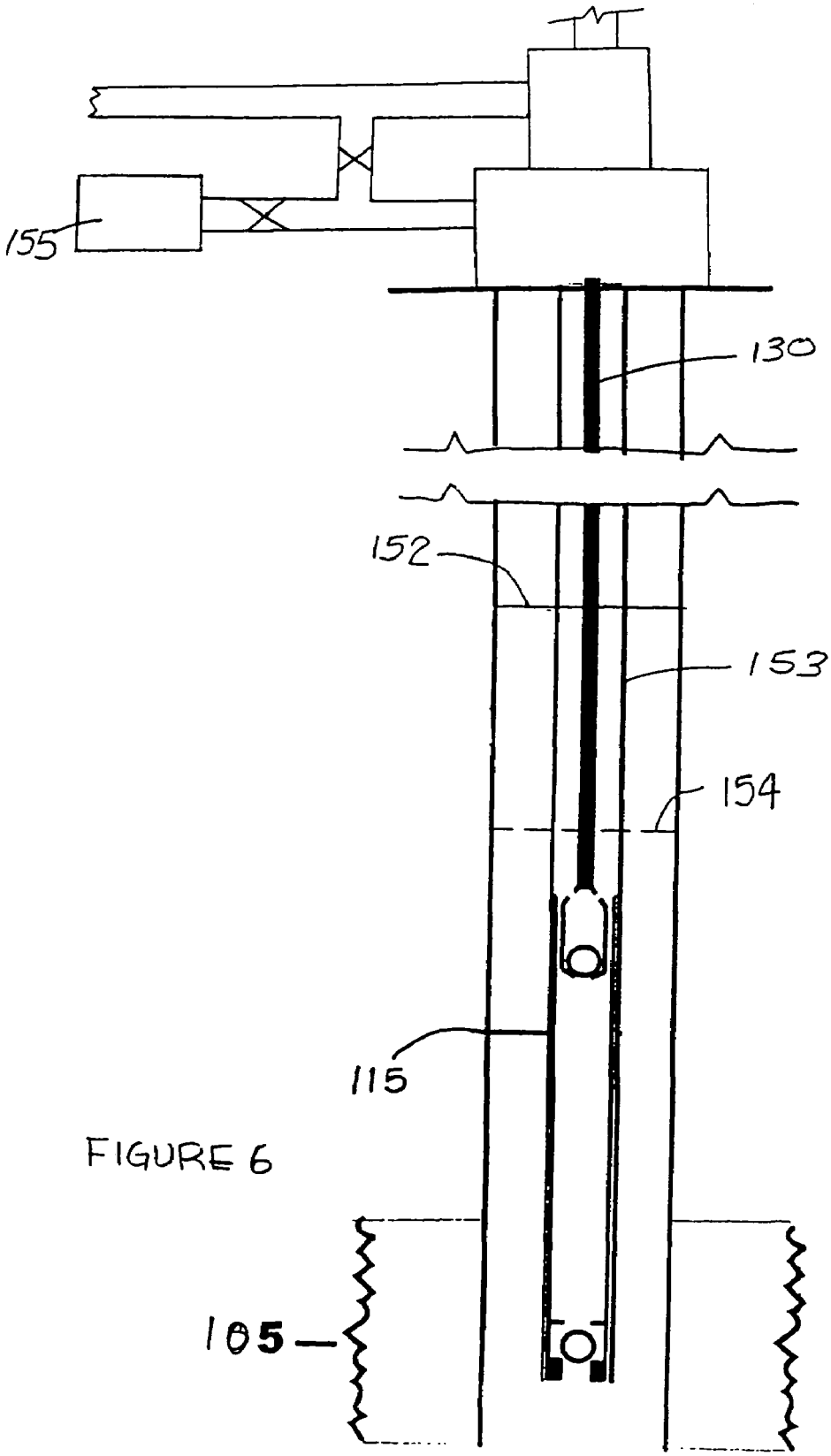
FIG. 6 conceptually shows an elevation view of a portion of the well system of FIG. 3 beneath the pumpjack.

FIG. 6 conceptually shows an elevation view of a portion of the well system 150 beneath the pumpjack 149. Pump 115 is operated by reciprocation of rod 130, which is driven by the above-ground motor 114 of FIG. 3, to pump fluid from oil-bearing formation 105 upward through production tubing 153. In some embodiments, the control circuitry 142 decreases power output from the motor 114 when the computed time intervals increase by more than a predetermined time increment dT (preferably pronounced "delta T"). The dT may be computed as a difference between a time interval corresponding to an upper fluid level 152 and a time interval corresponding to a lower fluid level 154. This dT may be computed when pumping the fluid level down from the upper fluid level 152 to the lower fluid level 154 at a distinct power setting of the motor 114. An ultrasonic level detector 155 known in the art (conceptually shown) may be used to compute a height of at least one of the upper and lower fluid levels 152, 154. For example, in calibrating the control circuitry 142, the fluid level may first be allowed to reach the upper allowable fluid level 152, as registered by the level detector 155. The motor 114 may then be set to a discrete upper power setting to begin driving down the fluid level, at which point the control circuitry 142 may register the time interval at the upper fluid level 152, e.g., corresponding to one complete cycle of the rod 130. When the fluid reaches the lower fluid level 154, the control circuitry 142 may register the time interval at that lower fluid level 154 corresponding to another full cycle of the rod 130. The dT may then be computed as the difference between those two time intervals. The dT may be stored in the control system 110, and used as reference data for subsequent operation of the well system 150.

EXAMPLE 2

The motor 114 has an upper and lower power setting. Using an ultrasonic level detector to calibrate the well, the maximum fluid level is determined to correspond to a time interval of 5090 ms and the minimum fluid level corresponds to 6010 ms (a dT of +/−20 ms). These values are programmed into the control system 110. During subsequent operation of the well system 150, the motor 114 may be turned on, and the control system 110 notes as signaled the time interval required for each full cycle of the rod 130 (or fraction thereof). The control system selects one of the time intervals as a reference time interval—preferably the first time interval (or one of the first several time intervals) computed after turning the motor on. The control system compares subsequent computed time intervals with the reference time interval. The motor 114 continues to run and the control circuitry 142 continues to compute time intervals until the control system 110 has detected an increase of at least 20 ms (dT) relative to the reference time interval. Then the control system 110 decreases power to the motor 114 to a lower power setting, and may wait for a predetermined period, such as 30 minutes.

EXAMPLE 3

As in Example 2, the motor 114 has an upper and lower power setting. Using an ultrasonic level detector to calibrate the well, the maximum fluid level is determined to correspond to a time interval of 5090 ms and the minimum fluid level corresponds to 6010 ms. These two time intervals are programmed into the control system 110. In contrast to Example 2, however, dT is not recorded. During subsequent operation of the well system 150, the motor 114 may be turned on to the same upper power setting used to calibrate the well. The control system 110 computes the time interval required for each full cycle (or fraction thereof) of the rod 130. The motor 114 continues to run and the control circuitry 142 continues to compute time intervals until the control system 110 has detected a time interval greater than or equal to 6010 ms, indicating the fluid has reached the lower fluid level 154. Then the control system 110 decreases power to the motor 114 to a lower power setting, such that the fluid level begins rising again. The control system 110 continues to compute time intervals until the last computed time interval is less than or equal to 5090 ms, indicating the fluid has reached the upper fluid level 152. The control system 110 then switches the motor back to the upper power setting.

Examples 2 and 3 are just two examples of how the control system 110 may govern fluid level according to the invention. Furthermore, although specific embodiments of the invention have been described herein in some detail, this has been done solely for the purposes of explaining the various aspects of the invention, and is not intended to limit the scope of the invention as defined in the claims which follow. Those skilled in the art will understand that the embodiments shown and described are exemplary, and various other substitutions, alterations, and modifications, including but not limited to those design alternatives specifically discussed herein, may be made in the practice of the invention without departing from its scope.

The invention claimed is:

1. A control system for governing fluid level in a well system, the well system including a pump positioned downhole for pumping fluid upward through a tubular, a rod positioned within the tubular for driving the pump, a prime mover, and a pumpjack to transmit power from the prime mover to the rod to reciprocate the rod, the control system comprising:

a sensor for sensing a position of the rod or a member of the pumpjack and outputting signals in response thereto; and a controller for receiving the signals and computing a time interval between signals, at least a portion of an upstroke of the rod occurring during the time interval, the controller decreasing power output from the prime mover in response to an increase in the computed time interval.

2. A control system as defined in claim 1, wherein the controller decreases power output from the prime mover when the computed time interval exceeds a prior computed time interval by at least a predetermined time increment.

3. A control system as defined in claim 2, wherein the predetermined time increment is computed as a difference between the time interval corresponding to an upper fluid level and the time interval corresponding to a lower fluid level when pumping the fluid level down from the upper fluid level to the lower fluid level at a distinct power setting of the prime mover.

4. A control system as defined in claim 3, wherein the controller decreases power output from the prime mover when the computed time interval exceeds a predetermined amount.

5. A control system as defined in claim 1, wherein the controller decreases power output from the prime mover by changing the prime mover from a distinct upper power setting to a distinct lower power setting.

6. A control system as defined in claim 1, wherein the controller decreases power output from the prime mover by turning off the prime mover.

7. A control system as defined in claim 1, wherein the controller increases power output from the prime mover after a selected period of time at the decreased power output.

8. A control system as defined in claim 1, wherein the sensor senses positioning of the rod or the member of the pumpjack at a selected position, and the controller computes the time interval between a positioning at the selected position and a subsequent positioning at the same selected position.

9. A control system as defined in claim 1, wherein the sensor senses positioning of the rod at a plurality of distinct positions, and the controller computes the time interval between positioning of the rod at one of the distinct positions and subsequent positioning of the rod at another of the distinct positions.

10. A control system as defined in claim 1, wherein the prime mover comprises:

a variable frequency motor.

11. A control system for governing fluid level in a well system, the well system including a pump positioned downhole for pumping fluid upward through a tubular, a rod positioned within the tubular for driving the pump, a prime mover comprising a variable frequency motor, and a pumpjack to transmit power from the prime mover to the rod to reciprocate the rod, the control system comprising:

a sensor for sensing a position of the rod or a member of the pumpjack and outputting signals in response thereto; and a controller for receiving the signals and computing a time interval between signals, at least a portion of an upstroke of the rod occurring during the time interval, the controller decreasing power output from the prime mover by changing the prime mover from a distinct upper power setting to a distinct lower power setting when the computed time interval exceeds a prior computed time interval by at least a predetermined time increment.

12. A control system as defined in claim 11, wherein the predetermined time increment is computed as a difference between the time interval corresponding to an upper fluid level and the time interval corresponding to a lower fluid level when pumping the fluid level down from the upper fluid level to the lower fluid level at a distinct power output setting of the prime mover.

13. A control system as defined in claim 12, further comprising:

an ultrasonic level detector to compute a height of at least one of the upper and lower fluid levels.

14. A control system as defined in claim 11, wherein the controller increases power output from the prime mover after a selected period of time at the lower power setting.

15. A control system as defined in claim 11, wherein the sensor senses positioning of the rod or the member of the pumpjack at a selected position, and the controller computes the time interval between a positioning at the selected position and a subsequent positioning at the same selected position.

16. A method for governing fluid level in a well system, the well system including a pump positioned downhole for pumping fluid upward through a tubular, a rod positioned within the tubular for driving the pump, a prime mover, and a pumpjack for transmitting power from the prime mover to the rod to reciprocate the rod, the method comprising:

sensing a position of the rod or a member of the pumpjack and outputting signals in response thereto;

computing a time interval between signals, at least a portion of an upstroke of the rod occurring during the time interval; and selectively decreasing power output from the prime mover in response to an increase in the computed time interval.

17. A method as defined in claim 16, further comprising:

decreasing power output from the prime mover when the computed time interval exceeds a prior computed time interval by at least a predetermined time increment, and computing the predetermined time increment as the difference between the time interval corresponding to an upper fluid level and the time interval corresponding to a lower fluid level when pumping the fluid level down from the upper fluid level to the lower fluid level at a distinct power setting of the prime mover.

18. A method as defined in claim 16, further comprising:

decreasing power output from the prime mover by changing the prime mover from a distinct upper power setting to a distinct lower power setting.

19. A method as defined in claim 16, further comprising:

decreasing power output from the prime mover by turning off the prime mover.

20. A method as defined in claim 16, further comprising:

increasing power output from the prime mover after a selected period of time at the decreased power output.

* * * * *